US008365486B2

(12) United States Patent
Jablonka

(10) Patent No.: US 8,365,486 B2
(45) Date of Patent: Feb. 5, 2013

(54) MULTI-LAYERED BUILDING WALL

(75) Inventor: Marcus Jablonka, Vineland (CA)

(73) Assignee: Ewald Dorken AG, Herdecke (DE)

( * ) Notice: Subject to any disclaimer, the term of this patent is extended or adjusted under 35 U.S.C. 154(b) by 0 days.

(21) Appl. No.: 10/592,157

(22) PCT Filed: Aug. 31, 2005

(86) PCT No.: PCT/EP2005/009393
§ 371 (c)(1),
(2), (4) Date: Sep. 8, 2006

(87) PCT Pub. No.: WO2006/024524
PCT Pub. Date: Mar. 9, 2006

(65) Prior Publication Data

US 2007/0193215 A1 Aug. 23, 2007

(30) Foreign Application Priority Data

Sep. 1, 2004 (DE) ..... 10 2004 042 667

(51) Int. Cl.
*E04B 1/70* (2006.01)
*E04B 5/00* (2006.01)
*E04F 17/00* (2006.01)
*E04H 7/22* (2006.01)

(52) U.S. Cl. ..... 52/302.1; 52/408

(58) Field of Classification Search ..... 52/302.1, 52/411, 415, 443, 408, 302.3
See application file for complete search history.

(56) References Cited

U.S. PATENT DOCUMENTS

| | | | | |
|---|---|---|---|---|
| 2,339,220 | A * | 1/1944 | Crowley | 52/282.4 |
| 3,866,372 | A * | 2/1975 | Haage | 52/309.11 |
| 4,840,515 | A * | 6/1989 | Freese | 405/45 |
| 4,956,951 | A * | 9/1990 | Kannankeril | 52/169.5 |
| 5,302,099 | A * | 4/1994 | Serafini | 425/84 |
| 5,673,521 | A * | 10/1997 | Coulton et al. | 52/199 |
| 5,688,073 | A * | 11/1997 | Brodeur et al. | 405/45 |
| 5,692,348 | A * | 12/1997 | Ambrosino | 52/169.5 |
| 5,902,432 | A * | 5/1999 | Coulton et al. | 156/199 |
| 5,946,872 | A * | 9/1999 | Pardo | 52/437 |
| 6,102,679 | A * | 8/2000 | Brown | 417/550 |
| 6,256,957 | B1 * | 7/2001 | Kelly | 52/413 |
| 6,355,333 | B1 * | 3/2002 | Waggoner et al. | 428/174 |
| 6,594,965 | B2 * | 7/2003 | Coulton | 52/302.1 |
| 6,715,249 | B2 * | 4/2004 | Rusek et al. | 52/481.1 |
| 6,745,531 | B1 * | 6/2004 | Egan | 52/302.1 |
| 6,786,013 | B2 * | 9/2004 | Coulton | 52/198 |
| 6,807,786 | B1 * | 10/2004 | Peck | 52/514.5 |

(Continued)

FOREIGN PATENT DOCUMENTS

| | | | |
|---|---|---|---|
| CA | 2350362 | A1 | 12/2001 |
| DE | 3127265 | A1 | 1/1983 |

(Continued)

*Primary Examiner* — Andrew Triggs
(74) *Attorney, Agent, or Firm* — Bachman & LaPointe, P.C.

(57) ABSTRACT

The invention relates to a multi-layered building wall provided with an inner wall comprising a building inner surface and an outer surface, and a façade layer forming the outer side of the building wall. The aim of the invention is to provide a multi-layered building wall, wherein damp penetrating the wall from the inside or the outside is reliably drained off. To this end, a draining vapor barrier (6) having a cavity-forming structure on both sides and an S<SB>D</SB>-value=50 m corresponding to an equivalent air layer thickness is arranged on the outer surface of the inner wall (4).

21 Claims, 8 Drawing Sheets

U.S. PATENT DOCUMENTS

| | | | | |
|---|---|---|---|---|
| 6,928,778 | B2 * | 8/2005 | Schmid | 52/363 |
| 6,964,136 | B2 * | 11/2005 | Collins et al. | 52/209 |
| 6,990,775 | B2 * | 1/2006 | Koester | 52/302.1 |
| 7,148,160 | B2 * | 12/2006 | Porter | 442/36 |
| 7,198,314 | B1 * | 4/2007 | Edwards | 296/26.04 |
| 7,488,523 | B1 * | 2/2009 | Muncaster et al. | 428/40.1 |
| 7,686,903 | B2 * | 3/2010 | Muncaster et al. | 156/71 |
| 2001/0054263 | A1 | 12/2001 | Coulton | |
| 2002/0108333 | A1 * | 8/2002 | Clayton | 52/302.1 |
| 2003/0215609 | A1 * | 11/2003 | Burkart | 428/141 |

FOREIGN PATENT DOCUMENTS

| | | | |
|---|---|---|---|
| DE | 10109090 | A1 | 9/2002 |
| EP | 1234927 | A2 | 8/2002 |
| JP | 2043434 | A | 2/1990 |
| JP | 10252173 | A | 9/1998 |

* cited by examiner

MULTI-LAYERED BUILDING WALL

The invention relates to a multi-layered building wall, including an inner wall, having a building inner surface, an outer surface and a façade layer forming the outside of the building wall.

Building walls of the type referred to in the opening paragraph, in which the inner wall is formed by external and internal panel elements, which are preferably fixed to a support structure anchored to the floor and constituting the frame structure of the inner wall, are used for the construction of residential houses, particularly in the North American and Scandinavian regions. In that case the inner wall is formed by the outer and the inner panel elements, which are preferably fixed to a support structure anchored to the floor, and which forms the frame construction of the inner wall. In that context, the support structure can be formed of metal profiles or also by spaced apart timber beams. As a rule, gypsum plasterboard panels are used as the inner panel elements, which permit a simple and cost-effective inner structure. In general, chip boards, for example OSB-panels are used as the outer panel elements. For thermal insulation suitable insulation materials are provided in the cavity between the outer and the inner panel elements.

In order to protect such inner walls, i.e. the support structure, the inner and outer panel elements and the insulation material provided in the spaces therebetween as well as, for example, solid inner walls against water penetration, in particular wind swept water, it is also already known to provide a sealing layer, for example asphalted cardboard, on the outer surface, where applicable exterior panel elements.

However, building walls of that type suffer from the disadvantage that rainwater will unavoidably enter into the region between the sealing layer and the façade layer in regions of building openings such as windows and doors or where the façade layer has been damaged and, once there, can no longer be drained away. The water there accumulated will by-and-by penetrate unavoidably into the inner wall at the weak points of the sealing layer, at the connecting localities with the outer surface or on the upper side of the building wall and will result there in a dampness which, in the long term, will result in rotting of the inner wall.

Moreover, the sealing layer applied to the outer surface prevents the escape from the inner wall of dampness once it is present in the inner wall. This will necessarily condense in the inner wall and result in damage there.

A multi-layered building wall of the genus referred to in the introduction is already known, in which between the outer panel element and the façade layer a profiled membrane is arranged. It is true that this permits a prompt drainage of water present between the façade layer and the profiled membrane. However, the lacking, material- or construction-dictated water vapour permeability of the profiled membrane results in that part of the water as well as dampness penetrates through the profiled membrane and enters into contact with the outer panel elements. Besides wind-driven rainwater, also moisture transport brought about by heating of the façade as a result of solar radiation impact, so-called "solar driven moisture", has a serious damaging effect on prior art building walls.

It is an object of the invention to provide a multi-layered building wall, in which moisture entering into the building wall from the inside or the outside, can be discharged from the building wall in a reliable manner.

The invention attains this object by a multi-layered building wall having the characterising features of claim 1. Advantageous further embodiments of the invention are set out in the dependent claims.

A characterising feature of the multi-layered building wall according to the invention is a drainage-permitting vapour barrier, having an $S_D$-value $\geqq 50$ m corresponding to an equivalent air layer thickness provided on the outside of the inner wall and providing on both sides a cavity forming structure.

It was surprisingly found that only with a building wall formed in accordance with the invention, including a vapour barrier having an equivalent air layer thickness of at least 50 m, it can be reliably prevented that dampness and water accumulated in front of the vapour barrier, enter into contact with the outer surface of the inner wall or penetrate into the inner wall—"in front of" within the context of the invention denoting the region between the façade layer and the vapour barrier and "behind" denoting the region between the outer surface of the inner wall and the vapour barrier. More particularly, only a building wall designed in accordance with the invention will ensure that the "solar driven moisture", which results in considerable damage in prior art building walls, will not penetrate through the vapour barrier.

The structure of the vapour barrier providing cavities on both sides thereof, ensures furthermore that water condensing on the vapour barrier will be drained reliably downwardly—expressions such as "down" and "upwardly" or "underside" and "upper side" within the context of the invention refer to an, in general, vertical installation position of the building wall—from where it can escape from the building wall. The cavity-forming structure, in this context, is so designed that even if the vapour barrier is fitted to the outside of the inner wall and the façade layer is fitted onto the vapour barrier, there remain sufficient cavities in which the dampness can condense and be drained. Accordingly, even dampness escaping from the inner wall and condensing behind the vapour barrier can be discharged reliably.

The wall construction according to the invention accordingly ensures to a particularly high extent that no dampness, resulting in rotting of the building wall, remains in the building wall or enters into the inner wall. The building wall accordingly, compared with prior art building walls, provides an increased life expectancy as well as an improved quality. A progressive deterioration of the heat transfer resistance of the building wall as a result of slowly progressing rotting of the insulation, is prevented effectively, dampness having penetrated at localities of weakness, in particular at door and window openings, being discharged reliably.

The drainage of the water collecting at the underside of the building wall can, in principle, proceed in optional manner. In regions, which are particularly susceptible, it is, where appropriate, possible to collect this in appropriately designed chambers and discharge it by means of suitable conveyance means, for example pumps. In accordance with a particularly advantageous embodiment of the invention, there is, however, provided on the upper side and/or underside an aperture in the region of the vapour barrier.

An aperture provided in the region of the underside of the building wall represents a particularly simple means for expelling from the building wall the water there accumulating. In this context, the aperture may be in contact with the atmosphere and permit the direct drainage of the water from the wall, or, on the other hand, may, for example, adjoin a soaking layer, which discharges the water emerging from the building wall.

A vapour pressure balancing between the atmosphere and the space before and behind the vapour barrier, may, in principle, also be brought about without apertures, for example by a suitable design of the vapour barrier. However, a vapour pressure balancing is ensured particularly easily by the advantageously provided apertures, which are open to the atmosphere. Where the aperture on the underside of the building wall adjoins a soaking layer, this may be accessible through an aperture provided on the upper side.

In order to prevent in all circumstances an air circulation between the atmosphere and the region in front of and behind the vapour barrier, which may possibly result in a chilling out of the insulation and which could at the same time result in moisture being transported into the building wall, a particularly advantageous embodiment of the invention provides that the apertures are of windproof design, more particularly being clad with brush formations, non-woven or other fibrous structures for sealing purposes. This embodiment of the invention ensures that moisture arising is discharged from the building wall whilst an airflow is simultaneously prevented. For that purpose, the sealing formations are so designed that airflows are inhibited substantially, but that water can penetrate. In addition, these sealing means prevent the entry of dirt particles or insects into the building wall, which might cause blockage of the cavities formed in front of or behind the vapour barrier and which would prevent a discharge of the water present there.

In principle, the inner wall may be formed in any suitable manner, for example by solid structures. However, in accordance with a particularly advantageous embodiment of the invention, the inner surface of the building is formed by internal panel elements and the outer surface of the inner wall by exterior panel elements. This mode of construction, in which the panel elements are fixed to a supporting structure, is distinguished by its low costs.

Fixing the vapour barrier to the outer panel elements and the façade layer may be performed, in principle, in optional manner. According to an advantageous further development of the invention, the upper side of the vapour barrier has, however, a high affinity for adhesives. This makes it possible to affix the vapour barrier particularly reliably by means of adhesives to the outer surface, where applicable exterior panel elements, as well as fitting the vapour barrier in such a manner to the façade layer that a particularly stable composite is attained.

The provision of a particularly high affinity may be brought about in numerous manners. In a particularly advantageous manner, the vapour barrier for that purpose includes a support layer on one or both sides, in particular a metal grid. Such a support layer permits a particularly reliable bonding with the use of adhesives, plaster, mortar or the like, in that these means become locked into the gaps of the metal grid. The support layer itself is advantageously embedded already in the vapour barrier during its manufacturing process.

In addition or as an alternative, it is possible according to an advantageous further development of the invention to connect the vapour barrier to the exterior panel elements in a positive interlocking manner, using self-sealing fastener elements, in particular self-sealing nails. Likewise, it is possible to nail the façade layer onto the vapour barrier using self-sealing nails. The use of such fastener elements, which serves as a positive interlocking connection of the exterior panel elements, the vapour barrier and the façade layer, results in a building wall, the bonding of which can be subjected to particularly high shear forces and has particularly high strength. The use of self-sealing fastener elements ensures in this context that the inherent sealing properties, i.e. the water and water vapour impermeability of the vapour barrier are preserved.

For the construction of the building wall according to the invention, a multitude of vapour barriers are suitable, which provide on both sides a cavity-forming structure and provide a water vapour density having an $S_D$ value of more than 50 m, the hollow spaces formed by the cavity-forming structure in the installed condition, i.e. in the loaded condition, preferably amount to at least 0.3 mm—viewed normal to the vapour barrier. Suitable foils may, for example, be used having non-woven or other structures on both sides thereof, which in the assembled condition of the building wall provide an adequately large cavity in front of and behind the vapour barrier for the discharge of the water accumulating there.

However, according to a particularly advantageous embodiment of the invention, the vapour barrier is provided by a profiled membrane having embossed bulging profiles on both sides. Such profiled membranes offer a particularly high pressure resistance so that in all circumstances the provision of adequately large cavities for the discharge of the water occurring there is ensured. Moreover, the profiled membrane provides a high density and strength. In addition, for such profiled membranes a multitude of self-sealing fastener means are already known so that the building wall as a whole can be produced particularly cost-effectively.

According to a further embodiment of the invention, the profiles, in addition, include undercut regions. These improve the fixing possibilities of a profiled membrane when using an adhesive or the like in a complementary manner, wherein the adhesive becomes bonded in the undercut regions and bonds the profiled membrane particularly reliably to the exterior panel elements and the façade layer.

The building wall according to the invention makes it possible that also moisture present in the inner wall, can diffuse out from there to condense behind the vapour barrier, from there to be discharged. According to an advantageous further development of the invention, the interior panel element, however, on its side facing the exterior panel element, includes a water vapour impervious layer, in particular a water vapour impervious foil. The latter reliably prevents moisture arising in the interior spaces from there entering into the inner wall. The accumulation of destructively acting moisture in the inner wall is thereby avoided in a complementary manner.

The design of the profiled membrane, in particular the configuration and height of the profiles is, in principle, freely selectable, subject to an adequately large cavity remaining, which ensures the discharge of the water accumulating at the vapour barrier. According to an advantageous embodiment, the profiles have a height of 1 mm to 50 mm, preferably of 2 mm to 25 mm, particularly preferred 3 mm to 12 mm. According to a particularly advantageous embodiment, the profiled membrane itself is furthermore made of polyolefins, in particular predominantly of PVC, polyethylene, polypropylene or a mixture of these. These materials are characterised by their particular durability and good processability as well as a high $S_D$ value.

According to a further development of the invention, the profiled membrane has an $S_D$ value of $\geqq 100$ m, in particular of $\geqq 400$ m. It has been found that such profiled membranes ensure in a particularly reliable manner that moisture arising in front of the vapour barrier is not conveyed into the inner wall.

According to a further embodiment of the invention, the vapour barrier in the region of the aperture provided at the underside, includes a dripping rail or a drainage rail with passage apertures. This rail is preferably connected to the vapour barrier in a liquid-tight manner or is formed integrally with the vapour barrier. The dripping or drainage rail provides a particularly reliable and controlled discharge of the water passed to the underside of the building wall. Moreover, if the underside of the building wall borders onto the soil and the rails are closed at their underside, these rails prevent the soil from being flushed out from underneath the building wall.

According to a further embodiment of the invention, the vapour barrier in the region of the aperture advantageously provided at the upper side, includes a profiled rail for preventing the entry of water. Like the dripping rail or drainage rail, this may be connected in a liquid-tight manner to the vapour barrier or be formed integrally with the latter. The profiled rail, if it has an appropriate configuration, prevents reliably the entry of water, in particular driving rain, into the building wall. Moreover, the profiled rail, subject to an appropriate configuration thereof, may prevent air circulation which could result in a chilling of the building wall. This is attained in a particularly advantageous embodiment by a sealing means, preventing the entry of water, provided in the region of the upper side of the vapour barrier.

In what follows, working examples of the invention are to be elucidated with reference to the drawings. In the drawings there is shown in:

FIG. 1 a sectional view of a first embodiment of a building wall in the floor region;

FIG. 2 a sectional view of a second embodiment of the building wall in the floor region;

FIG. 3 a sectional view of a third embodiment of the building wall in the floor region;

FIG. 4 a sectional view of the first embodiment of the building wall according to FIG. 1 in the region of a window;

FIG. 5 a sectional view of the second embodiment of the building wall according to FIG. 2 in the region of a window and FIG. 6 a sectional view of the third embodiment of the building wall according to FIG. 3 in the region of a window.

Figure 1:
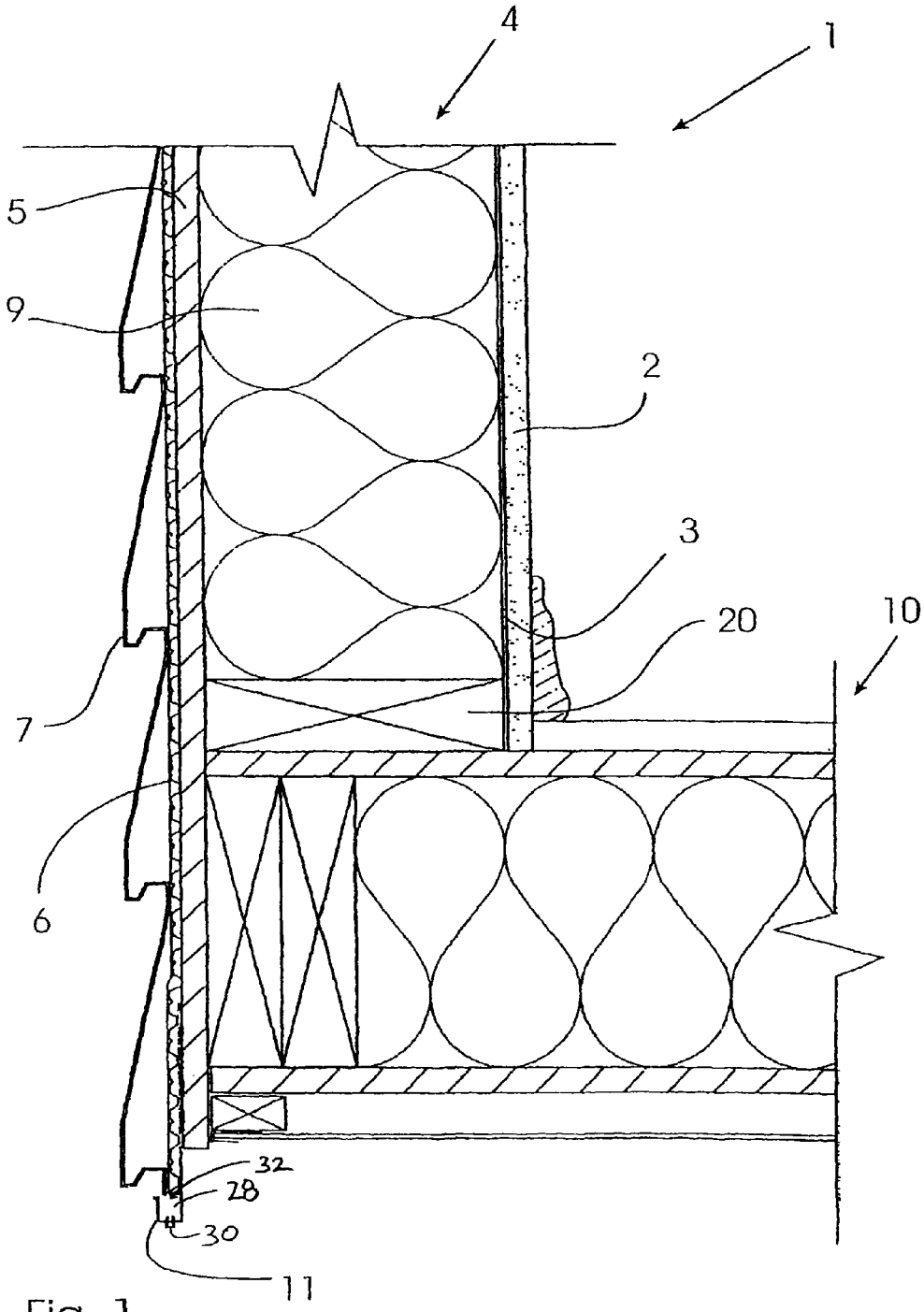

FIG. 1 represents a sectional view of a building wall 1 in the region of a floor 10 bordering an underside of the building wall 1.

An inner wall 4 forms a part of the building wall 1. The former comprises gypsum plasterboard panels 2, which form the inside of the building wall 1 and are fitted to a wood frame construction which here is only partly visible, formed of timber supports extending vertically from the floor as well as bottom beams 20 extending parallel to the floor 10.

Between the side of the wood frame construction facing the interior and the gypsum plasterboard panels 2, a water vapour tight foil 3 is applied serving as a moisture barrier against moisture arising in the building. The exterior of the inner wall 4 is formed by OSB-panels 5, which are applied to the wood frame construction on the side opposite to the gypsum plasterboard panels 2. An inner wall insulation 9 is provided in the cavities of the wood frame construction, i.e. between the gypsum plaster boards 2 and the OSB-panels 5. On the outside of the inner wall 4, i.e. on the OSB-panel 5 a draining vapour barrier in the form of a profiled membrane 6 is adhesively fitted to form on both sides a structure providing a cavity. On its front and rear side, i.e. between a façade surface 7 applied to the outside of the profiled membrane 6 and the profiled membrane 6 as well as between the OSB-board 5 and the profiled membrane 6, the latter in each case forms a coherent cavity, extending from the upper side of the building wall down to its underside. These cavities reliably drain towards the underside any water penetrated into or condensed in the building wall 1.

Figure 2:
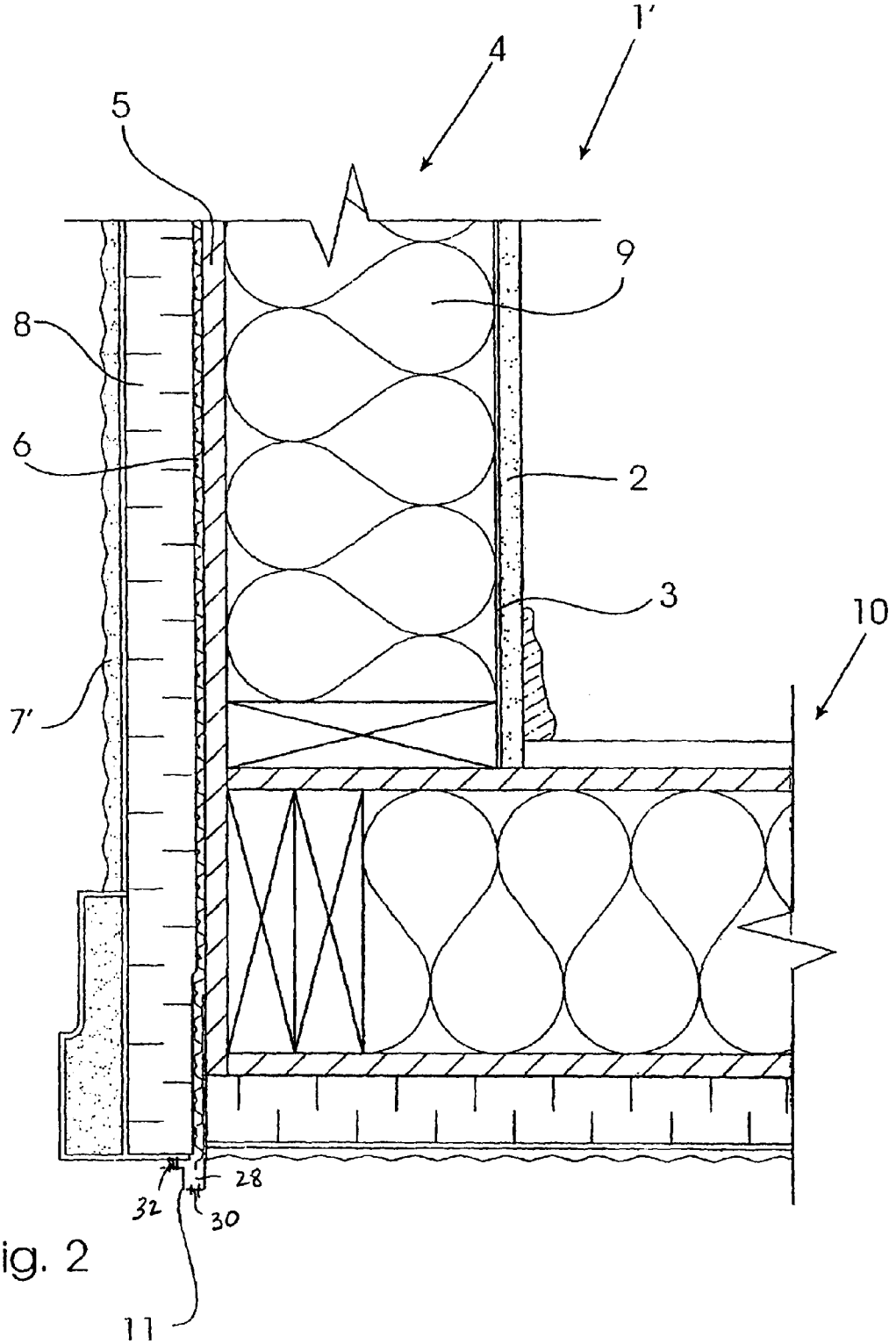
Figure 3:
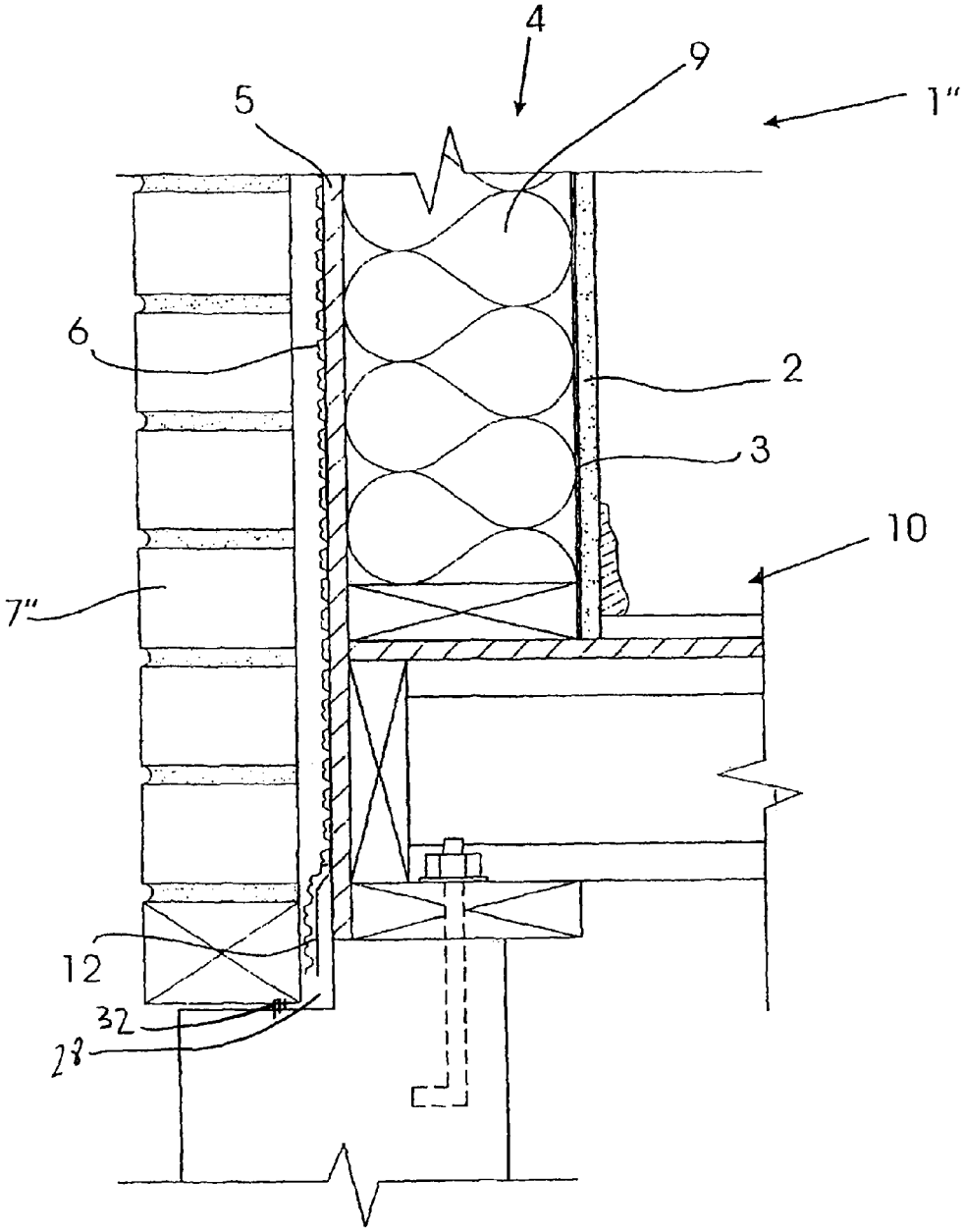

As shown in FIGS. 1-3, an aperture 28 can be provided on in the region of the vapour barrier (6). Apertures 28 can be provided with brush formations, non-woven or other fibrous structures schematically illustrated at 32.

In the region of the underside of the profiled membrane 6 a drainage rail 11 is connected to the profiled membrane 6. The drainage rail 11 has a U-shaped cross-section with a limb-shaped extension. The water collecting in the building wall 1 is collected in the U-shaped profile of the drainage rail 11 and from there passes through passage apertures schematically illustrated at 30 (FIGS. 1, 2) provided in the drainage rail 11 into the soil surrounding the drainage rail 11 or a soaking layer there provided, but not illustrated here.

In FIG. 2 a further embodiment of a building wall 1' is illustrated. The building wall 1' illustrated in FIG. 2 differs from the building wall 1 illustrated in FIG. 1 by a different design in the region of the profiled membrane 6. Instead of the façade layer 7 illustrated in FIG. 1, an insulation layer 8 is provided in front of the profiled membrane 6, onto which, in turn, a plaster layer 7' has been applied. The discharge of water accumulating between the insulation layer 8 and the profiled membrane 6 as well as between the profiled membrane 6 and the OSB-board 5 proceeds in the manner illustrated in FIG. 1 at the underside of the building wall 1' by way of the drainage rail 11 provided there.

The building wall 1" illustrated in FIG. 3 differs from the embodiments of the building walls 1, 1' illustrated in FIGS. 1 and 2 by a different design in the region of the profiled membrane 6. In contrast to the building walls 1, 1' illustrated in FIGS. 1 and 2, the building wall 1" illustrated in FIG. 3 includes a masonry structure 7" provided in front of the profiled membrane 6. A ducting rail 12 provided in the region of the underside of the profiled membrane 6 ensures that water accumulating does not enter into contact with the OSB-board 5, but is discharged at the underside of the masonry 7". For that purpose, the terminal bricks of the masonry 7" include passage apertures, not illustrated here, which permit the passage of the water from the masonry 7".

Figure 4:
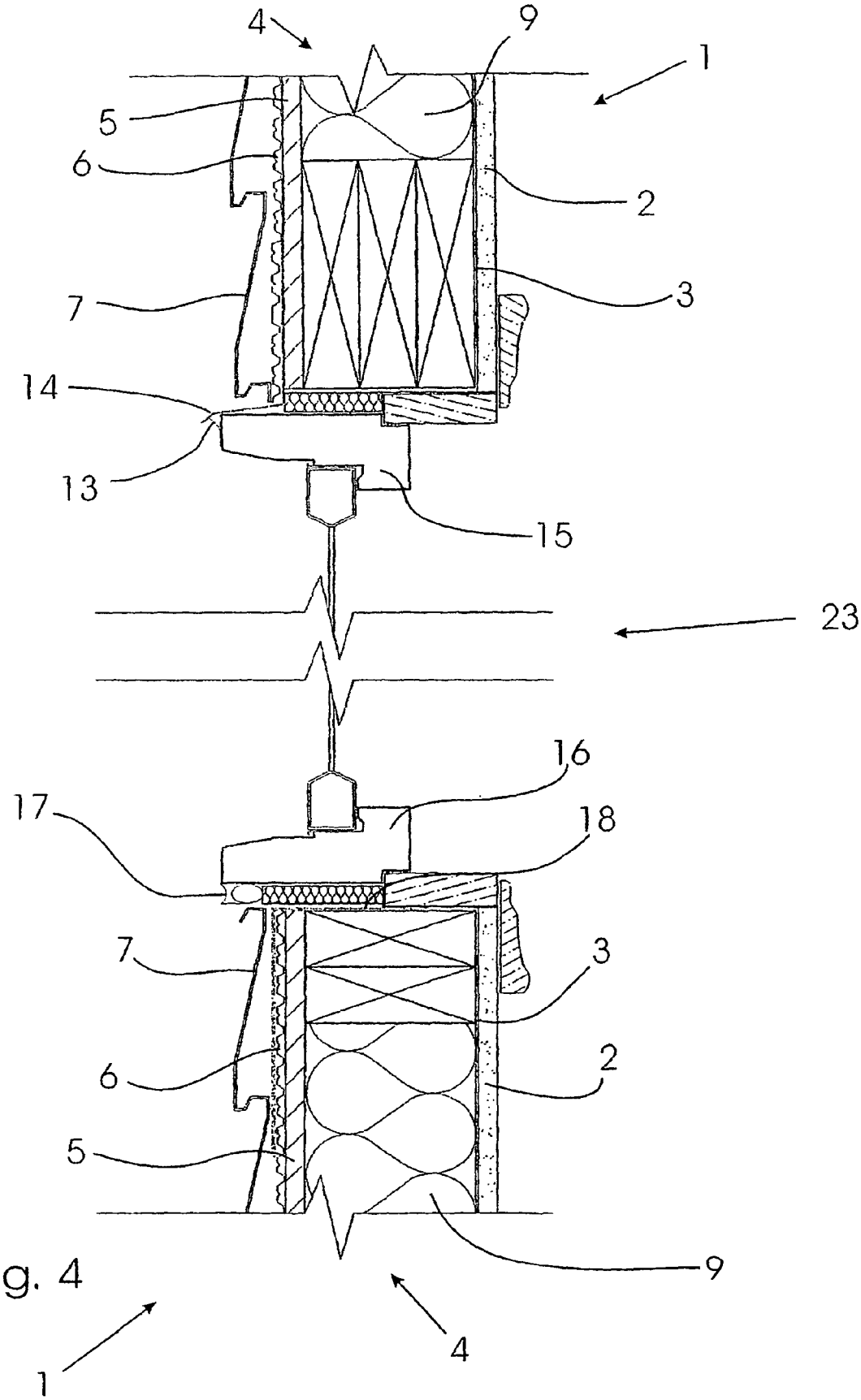
Figure 5:
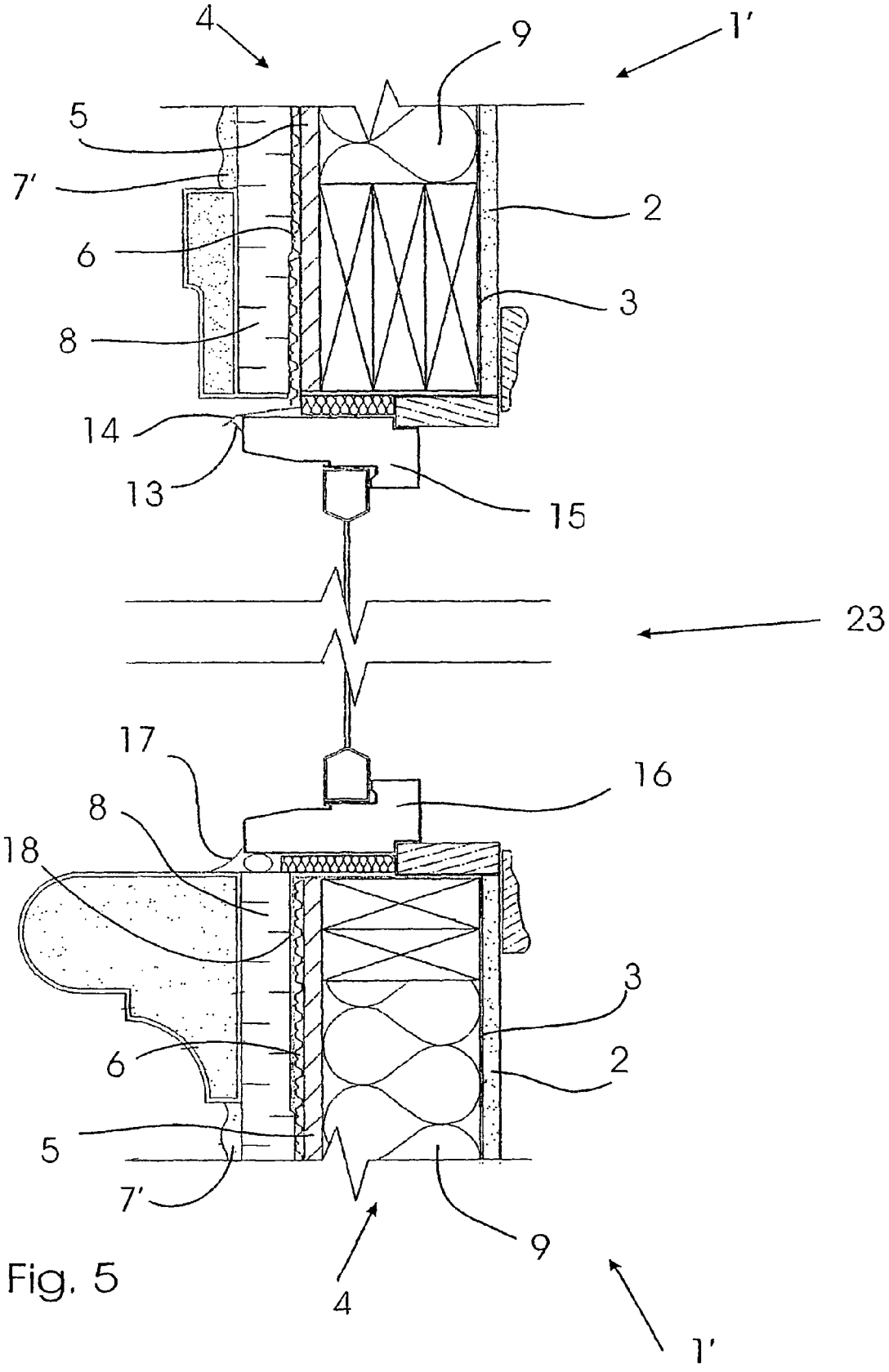
Figure 6:
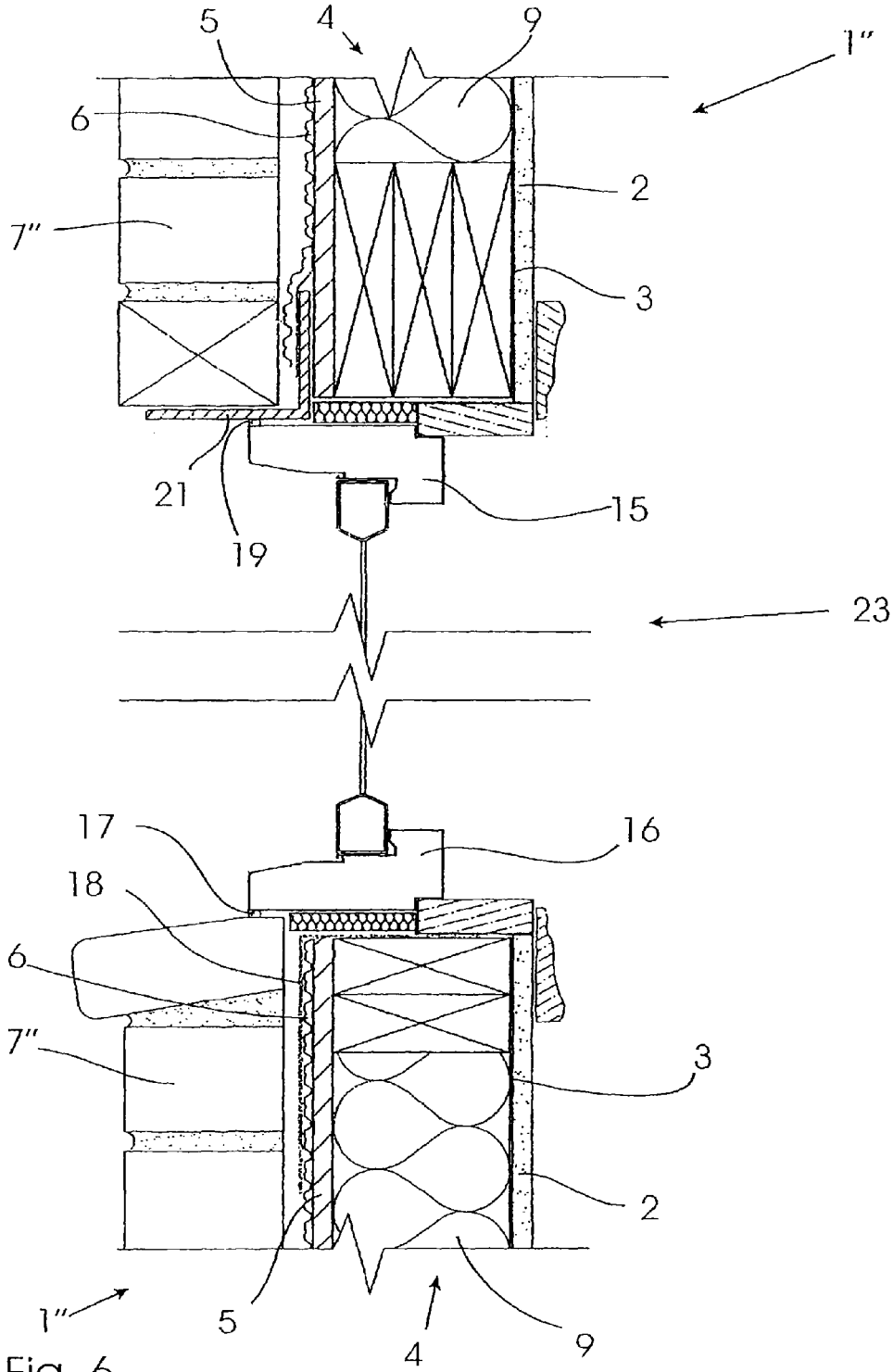

In FIGS. 4-6 the construction of the building walls 1, 1', 1" illustrated in FIGS. 1 to 3 is shown in the region of an upper and an underside of a window 23. Above an upper window frame 15 the profiled membrane 6 is connected to a dripping rail 14, which conducts the accumulating water past the upper side of the upper window frame 15 out of the building wall 1. In order to avoid, in the course thereof, that between the underside of the dripping rail 14 and the upper window frame 15 water, for example wind-driven rainwater, penetrates into the building wall 1, a sealing means 13 is there provided.

In the region of an upper side of the building wall 1, for example in the region of an underside of a lower window frame 16, a sealing means 17 is provided, which prevents the entry of water, in particular of wind-driven rain. In addition to this, the inner wall 4 includes a cladding 18 which covers the upper edge as well as the upper region of the profiled membrane 6 and which prevents water, which may have penetrated at the upper side of the inner wall 4, to flow into the latter.

The embodiment illustrated in FIG. 5 differs once again by a difference in structure of the building wall 1' in front of the profiled membrane 6, that is to say by the insulation 8 which is there applied and the plaster layer 7' provided on top thereof. As for the remainder, the structure corresponds to the structure illustrated in FIG. 4, the dripping rail 14 in the region of the upper window frame 15 positively discharging the water from the inside of the building wall 1', and a sealing means 13 preventing the entry of water. In the region of the lower window frame 16 once again a sealing means 17 prevents the entry of moisture and water at the upper side of the building wall 1'.

The wall structure 1" illustrated in FIG. 6 includes a masonry 7" as in the case of the wall structure 1 illustrated in FIG. 3, in front of the profiled membrane 6. Above the upper window frame 15 the profiled membrane 6 is connected to a rail 14, which in contrast, however, to the embodiments illustrated in FIGS. 4 and 5 does not lead outside of the building wall 1". The latter is connected in its lower region to a steel rail 21, which on the one hand passes the water from the building wall 1" outside and, on the other hand, serves as a support for the masonry structure 7". In addition, the lowermost brick is provided with apertures, not illustrated here, through which the water can drain to the outside from the building wall 1". A sealing means 19 between the underside of the steel rail 21 and the upper side of the upper window frame 15 prevents the entry of water at this position into the building wall 1".

The structure in the region below the lower window frame 16 is once again designed as in the embodiment of the building wall 1, 1' as illustrated in FIGS. 5 and 6. A sealing means 17 between the underside of the lower window frame 16 and the upper side of the masonry structure 7" terminating below the lower window frame 16, is sealed by a sealing means 17.

In accordance with an embodiment of the invention, not illustrated here, a composite is used as the drainage-providing vapour barrier, instead of the profiled membrane 6. This composite is formed of a polypropylene foil having a thickness of 200 μm which on both sides comprises a needle-stitched polypropylene staple fibre non-woven, having a density of 300 g/m$^2$, which is laminated onto the polypropylene foil. In its unloaded installation condition, the polypropylene staple fibre non-woven provides free drainage cavities on both sides having a height of at least 0.3 mm.

Figure 7:
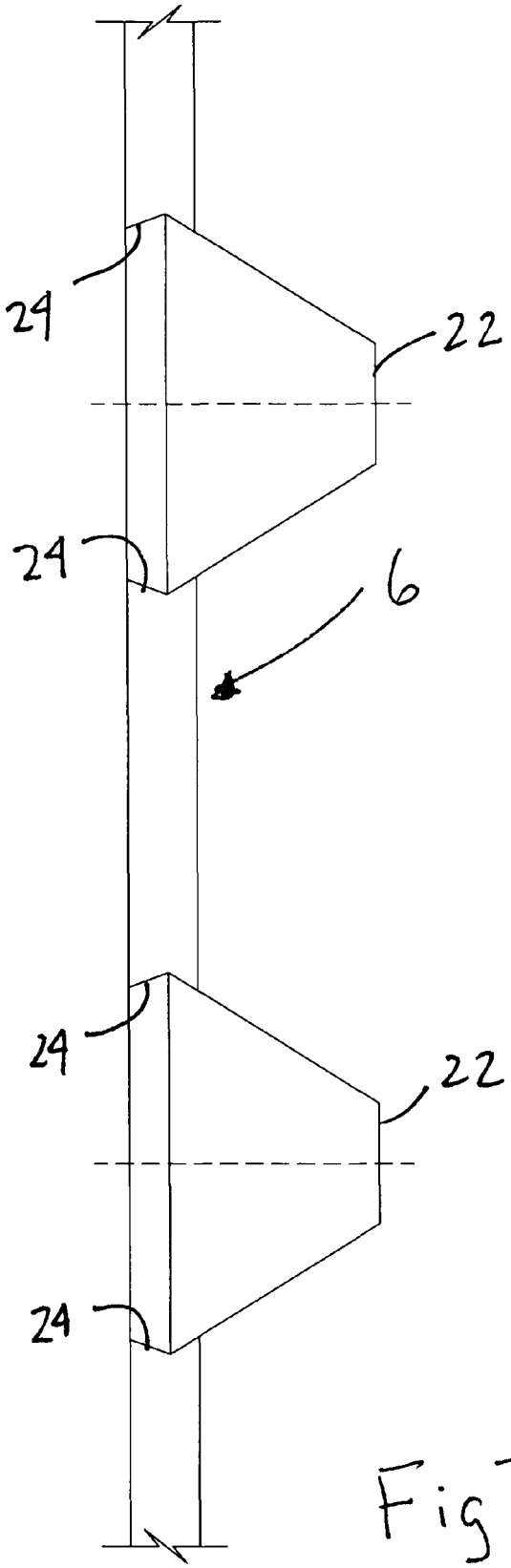
FIG. 7 is a sectional schematic view of an enlarged portion of a profiled membrane showing undercut regions according to the invention.

According to a further embodiment of the invention illustrated in FIG. 7, the profiles 22, in addition, include undercut regions 24. These improve the fixing possibilities of a profiled membrane 6 when using an adhesive or the like in a complementary manner, wherein the adhesive becomes bonded in the undercut regions 24 and bonds the profiled membrane 6 particularly reliably to the exterior panel elements and the façade layer.

Figure 8:
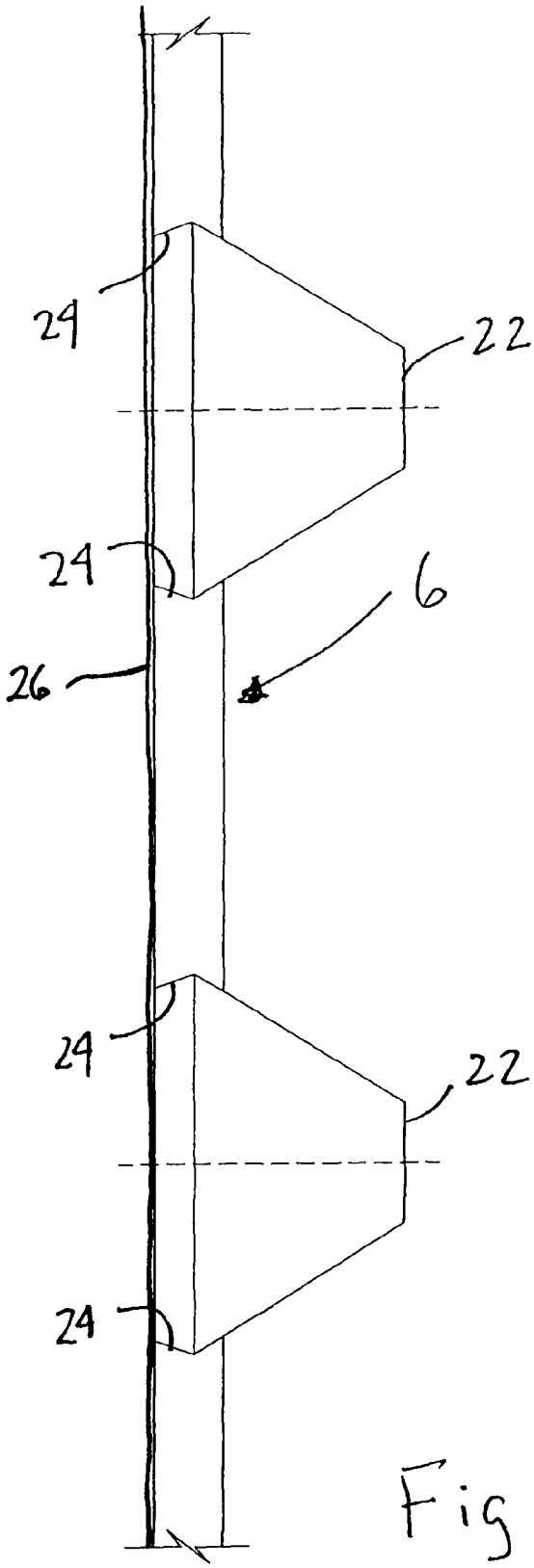
FIG. 8 is a sectional schematic view of an enlarged portion of a profiled membrane showing a metal grid attached to one surface of the profiled membrane.

According to a further embodiment of the invention illustrated in FIG. 8, a vapour barrier in the form of profiled membrane 6 is illustrated having a support layer in the form of a metal grid 26 attached to one surface thereof.

The invention claimed is:

1. Multi-layered building wall, including
an inner wall, having
a building inner surface,
an outer surface of the inner wall and
a façade layer forming the outside of the building wall,
characterised in that
on the outside of the inner wall (4) a drainage-permitting vapour barrier (6) is provided, in the form of a polymer membrane which is substantially free of perforations and is made from a material selected from the group consisting of polyethylene, polypropylene, PVC and combinations thereof and has a thickness sufficient to provide an $S_D$ value greater than or equal to 50 m corresponding to an equivalent air layer thickness and providing a cavity-forming structure for discharge of water on both sides of the vapour barrier.

2. Multi-layered building wall according to claim 1, characterised in that an aperture is provided on the upper side and/or underside in the region of the vapour barrier (6).

3. Multi-layered building wall according to claim 2, characterised in that the aperture is provided with brush formations, non-woven or other fibrous structures for resisting air circulation.

4. Multi-layered building wall according to claim 1, characterised in that the inner surface of the building wall is formed by internal panel elements (2) and the outer surface of the inner wall (4) by exterior panel elements (5).

5. Multi-layered building wall according to claim 1, characterised in that the vapour barrier (6) includes a support layer on one or both sides.

6. Multi-layered building wall according to claim 1, characterised in that at least one side of the vapour barrier has a high affinity for adhesives.

7. Multi-layered building wall according to claim 1, characterised in that the vapour barrier (6) is connected to the exterior panels (5) in a positive interlocking manner by self-sealing fastener elements, and wherein the self-sealing fastener elements comprise sealing nails.

8. Multi-layered building wall according to claim 1, characterised in that the hollow spaces formed by the cavity-forming structure amount to at least 0.3 mm in the installed position.

9. Multi-layered building wall according to claim 1, characterised in that the vapour barrier is formed by a profiled membrane (6) having embossed bulging profiles on both sides.

10. Multi-layered building wall according to claim 1, characterised in that the vapour barrier is formed by a profiled membrane (6) having profiles and wherein the profiles include undercut regions (24) defined around a base of the profiles.

11. Multi-layered building wall according to claim 1, characterised in that a water vapour impervious layer (3) is provided on the inner surface of the building or the interior panel element (2).

12. Multi-layered building wall according to claim 1, characterised in that the vapour barrier is formed by a profiled membrane (6) having profiles on both sides and wherein the profiles have a height of 1 mm to 50 mm.

13. Multi-layered building wall according to claim 1, characterised in that the vapour barrier is formed by a profiled membrane (6) having profiles on both sides.

14. Multi-layered building wall according to claim 1, characterised in that the profiled membrane (6) has an $S_D$ value of greater than or equal to 100 m.

15. Multi-layered building wall according to claim 2, characterised in that the vapour barrier (6) in the region of the aperture provided at the underside is connected to a dripping rail (14) or a drainage rail (11) with passage apertures.

16. Multi-layered building wall according to claim 2, characterised in that the vapour barrier (6) has an aperture at the upper side, and wherein the vapour barrier, in the region of the aperture provided at the upper side is connected to a profiled rail for preventing the entry of water.

17. Multi-layered building wall according to claim 1, characterised by a sealing means (17) provided in the region of the upper side of the vapour barrier (6), preventing the entry of water.

18. Multi-layered building wall according to claim 1, characterised in that the vapour barrier is formed by a profiled membrane (6) having profiles on both sides and wherein the profiles have a height of 2 mm to 25 mm.

19. Multi-layered building wall according to claim 1, characterised in that the vapour barrier is formed by a profiled membrane (6) having profiles on both sides and wherein the profiles have a height of 3 mm to 12 mm.

20. Multi-layered building wall according to claim 1, characterised in that the vapour barrier is formed by a profiled membrane (6) having profiles on both sides and wherein the profiled membrane (6) has an $S_D$ value of greater than or equal to 400 m.

21. Multi-layered building wall according to claim 5, wherein the support layer comprises a metal grid.

* * * * *